US009745523B2

(12) United States Patent
Ganguly et al.

(10) Patent No.: US 9,745,523 B2
(45) Date of Patent: Aug. 29, 2017

(54) METHODS AND APPARATUSES FOR HYDROTREATING

(71) Applicant: UOP LLC, Des Plaines, IL (US)

(72) Inventors: Sujoy Ganguly, Gurgaon (IN); Kenneth D. Peters, Elmhurst, IL (US)

(73) Assignee: UOP LLC, Des Plaines, IL (US)

( * ) Notice: Subject to any disclaimer, the term of this patent is extended or adjusted under 35 U.S.C. 154(b) by 251 days.

(21) Appl. No.: 14/692,542

(22) Filed: Apr. 21, 2015

(65) Prior Publication Data

US 2016/0312128 A1 Oct. 27, 2016

(51) Int. Cl.

| | |
|---|---|
| ***C10G 45/02*** | (2006.01) |
| ***C10G 45/72*** | (2006.01) |
| ***C10G 49/26*** | (2006.01) |
| ***C10G 45/00*** | (2006.01) |

(52) U.S. Cl.

CPC ..... *C10G 45/02* (2013.01); *C10G 45/00* (2013.01); *C10G 45/72* (2013.01); *C10G 49/26* (2013.01); *C10G 2300/104* (2013.01); *C10G 2300/1044* (2013.01); *C10G 2300/4006* (2013.01); *C10G 2300/4056* (2013.01); *C10G 2400/02* (2013.01)

(58) Field of Classification Search

CPC ..... C10G 45/02; C10G 45/72; C10G 49/26

See application file for complete search history.

(56) References Cited

U.S. PATENT DOCUMENTS

| | | | | |
|---|---|---|---|---|
| 7,005,058 | B1 * | 2/2006 | Towler | C10G 45/72 208/211 |
| 2007/0007177 | A1 * | 1/2007 | Hunter | C10G 45/02 208/214 |
| 2010/0243521 | A1 * | 9/2010 | Peters | C10G 9/00 208/63 |

* cited by examiner

*Primary Examiner* — Renee Robinson

(57) ABSTRACT

Embodiments of methods and apparatuses for hydrotreating hydrocarbons are provided. An exemplary method includes hydrotreating a hydrocarbon feed comprising heating a hydrotreating zone effluent to produce a heated hydrotreating zone effluent. An indirect heat exchange takes place between the heated hydrotreating zone effluent and hydrocarbon feed to provide a heated hydrocarbon feed.

12 Claims, 1 Drawing Sheet

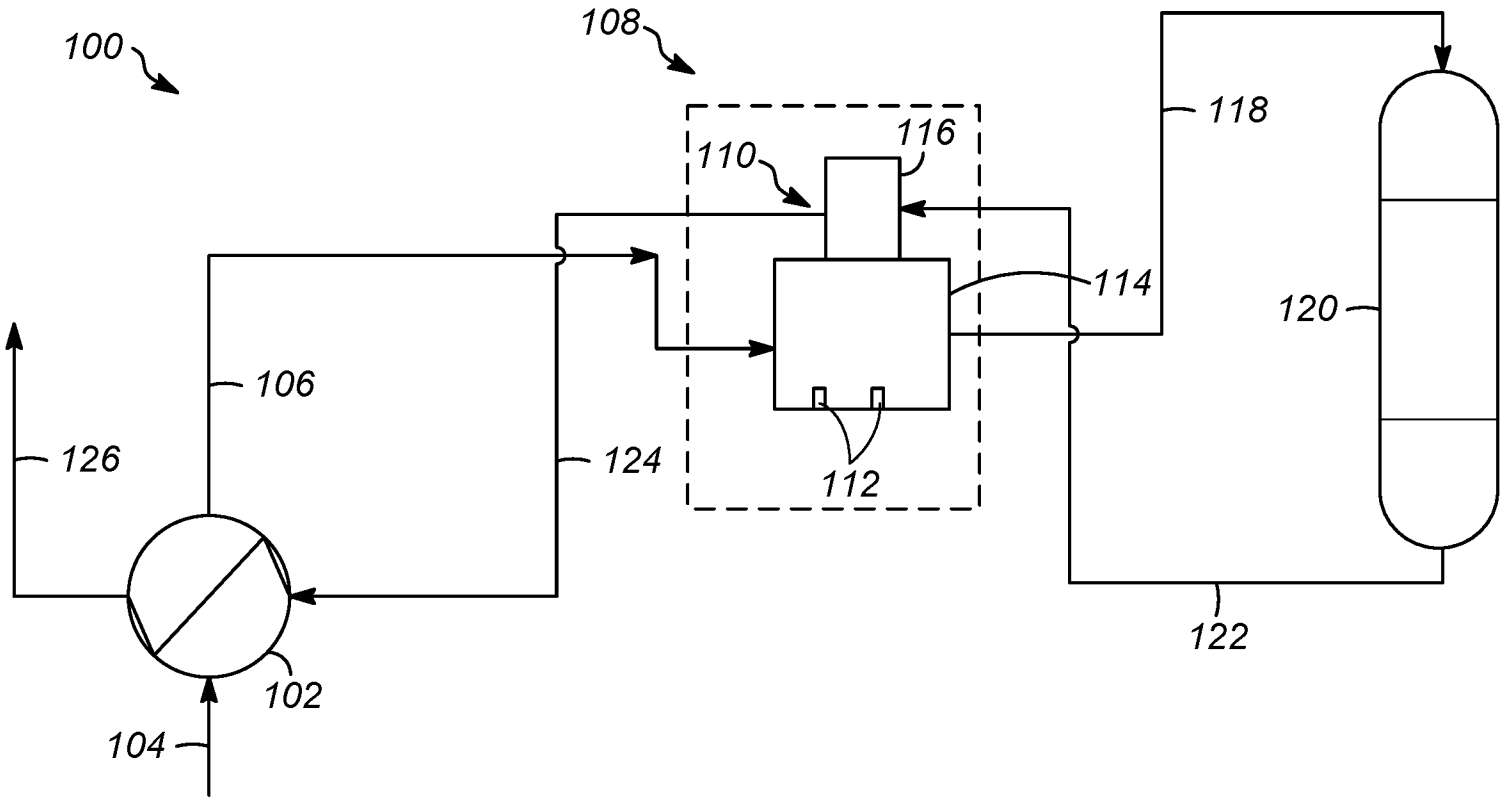
100
108
110
116
112
114
118
120
122
124
106
102
104
126

METHODS AND APPARATUSES FOR HYDROTREATING

TECHNICAL FIELD

The technical field generally relates to methods and apparatuses for hydrotreating, more particularly to heating a hydrotreater reactor effluent to debottleneck a combined feed exchanger for revamps.

BACKGROUND

Earlier Naphtha Hydrotreating (NHT) reactors were designed to operate at very high temperatures of around up to 750° F. Accordingly, the combined feed exchanger was small. However, in recent times, the importance of keeping lower temperatures in the naphtha hydrotreating reactor has been realized. This temperature reduction is performed primarily to reduce the deactivation of the catalyst at high temperatures and secondly to reduce sulfur recombination reactions inside the reactor.

In the existing naphtha hydrotreating processes, the combined feed to the charge heater is heated via indirect heat exchange with the hydrotreating reactor effluent. The combined feed from the combined feed exchanger (CFE) shell side first enters the convection section of the charge heater and then flows to the radiant section. Subsequently, the combined feed is introduced to the NHT reactor and the resulting effluent is sent directly to the CFE for the indirect heat exchange. One problem associated with the revamping of such old naphtha hydrotreating units is that the existing CFE is found to be inadequate for revamps due to the need for more CFE surface area with a large number of CFE shells at the lower reactor outlet temperatures. When the reactor outlet temperature is too low, the existing smaller CFEs are not able to preheat the combined feed to a temperature that fully vaporizes the combined feed. Having two-phase flow through an NHT charge heater, especially a multi-pass heater, can cause maldistribution of the combined feed in the individual heater passes. Further, one or more passes could become liquid full and potentially overheat and lead to a tube failure. Even in single pass heaters it is recommended to have the combined feed fully vaporized inside a fired heater, being well above the dry point inside the tubes. Therefore, the existing smaller CFEs become inadequate to extract enough heat from the reactor effluent to fully vaporize the combined feed to the charge heater.

One of the existing solutions by which this NHT operation can meet revamp requirements is by adding multiple shells in series to the existing CFE. However, there are several drawbacks associated with adding more CFE shells in series. These drawbacks may include extra capital cost of the new exchangers and piping, availability of plot space to install multiple exchangers in series, and finally increased pressure drop in the reactor circuit potentially rendering the recycle compressor inadequate for the revamp.

Accordingly, it is desirable to provide methods and apparatuses to economically provide the additional combined feed preheat required to ensure the existing CFE provide a fully vaporized combined feed stream to the charge heater. Furthermore, other desirable features and characteristics of the present embodiment will become apparent from the subsequent detailed description and the appended claims, taken in conjunction with the accompanying drawing and this background.

SUMMARY

Various embodiments contemplated herein relate to hydrotreating of a hydrocarbon feed including heating a hydrotreating reactor effluent to debottleneck combined feed exchanger for revamps. The exemplary embodiments taught herein heat a hydrocarbon feed to provide a heated hydrocarbon feed. The hydrotreating reactor effluent from the hydrotreating zone is heated to a desired temperature prior to indirect heat exchange with the hydrocarbon feed to produce the heated hydrocarbon feed.

In accordance with an exemplary embodiment, a method includes hydrotreating a hydrocarbon feed comprising heating a hydrotreating zone effluent to produce a heated hydrotreating zone effluent and indirect heat exchanging the heated hydrotreating zone effluent with the hydrocarbon feed to provide a heated hydrocarbon feed.

In accordance with another exemplary embodiment, a method includes hydrotreating a hydrocarbon feed comprising heating the hydrocarbon feed to provide a heated hydrocarbon feed. The heated hydrocarbon feed is heated to produce a heated hydrotreating zone feed. The heated hydrotreating zone feed is provided to a hydrotreating zone to provide a hydrotreating zone effluent. The hydrotreating zone effluent is heated to produce a heated hydrotreating zone effluent and the heated hydrotreating zone effluent is indirectly heat exchanged with the hydrocarbon feed to provide the heated hydrocarbon feed.

In accordance with yet another exemplary embodiment, an apparatus for hydrotreating of a hydrocarbon feed includes a combined feed exchanger, a hydrotreating heating zone in fluid communication with the combined feed exchanger and comprising a charge heater and a hydrotreating zone that is in fluid communication with the hydrotreating heating zone. The hydrotreating heating zone is in downstream communication with the hydrotreating zone and the combined feed exchanger is in downstream communication with the hydrotreating heating zone.

BRIEF DESCRIPTION OF THE DRAWINGS

The various embodiments will hereinafter be described in conjunction with the following drawing figures, wherein like numerals denote like elements, and wherein:

The FIGURE illustrates an apparatus and a method for hydrotreating of hydrocarbons in accordance with an exemplary embodiment of the present subject matter.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "bypass" means that the object is out of downstream communication with a bypassing subject at least to the extent of bypassing.

The term "zone" refers to an area including one or more equipment items and/or one or more sub-zones. Equipment items can include one or more reactors or reactor vessels, scrubbers, strippers, fractionators or distillation columns, absorbers or absorber vessels, regenerators, heaters, exchangers, coolers/chillers, pipes, pumps, compressors, controllers, and the like.

The notation "Cx" means hydrocarbon molecules that have "x" number of carbon atoms, Cx+ means hydrocarbon molecules that have "x" and/or more than "x" number of carbon atoms, and Cx− means hydrocarbon molecules that have "x" and/or less than "x" number of carbon atoms.

DETAILED DESCRIPTION

The following detailed description is merely exemplary in nature and is not intended to limit the application or uses of the embodiment described. Furthermore, there is no intention to be bound by any theory presented in the preceding technical field, background, brief summary, or the following detailed description.

Various embodiments contemplated herein relate to hydrotreating of a hydrocarbon feed including heating a hydrotreating reactor effluent to debottleneck a combined feed exchanger for revamps. The exemplary embodiments taught herein heat a hydrocarbon feed to provide a heated hydrocarbon feed. The heated hydrocarbon feed is further heated to produce a heated hydrotreating zone feed.

In an exemplary embodiment, further heating the heated hydrocarbon feed includes passing the heated hydrocarbon through at least one heater comprising a charge heater. The heated hydrotreating zone feed is provided to a hydrotreating zone to provide a hydrotreating zone effluent. The hydrotreating zone effluent is heated to produce a heated hydrotreating zone effluent. In an exemplary embodiment, the hydrotreating zone effluent is heated in the at least one heater comprising the charge heater. Further, the heated hydrotreating zone effluent is indirectly heat exchanged with the hydrocarbon feed to provide the heated hydrocarbon feed.

Suitable hydrocarbon feeds include straight run and full range naphtha from fluid catalytic cracking operations, although the use of other petroleum feedstocks is possible. Alternative feedstocks include various other types of hydrocarbon mixtures, such as cracked naphtha obtained as a product of steam cracking, thermal cracking, visbreaking or delayed coking. Further, the hydrocarbon feed can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The hydrocarbon feed can also include aromatic and non-aromatic hydrocarbons.

Referring now to FIGURE, an apparatus and method 100 for hydrotreating of hydrocarbons is provided. The apparatus and method 100 includes a combined feed exchanger 102, a hydrotreating heating zone 108 and a hydrotreating zone 120. For the purposes of the instant embodiment, the hydrotreating heating zone is shown to include a charge heater 110. The charge heater 110 includes a plurality of burners 112, a radiant section 114 and a convection section 116 typically above the radiant section 114.

A hydrocarbon feed 104 containing naphtha fraction of hydrocarbons, such as from C5 to about C12 hydrocarbons having a T5 boiling point of about 15-50° C. and T90 boiling point of about 200-225° C., is introduced to the combined feed exchanger 102 to heat the hydrocarbon feed 104 to provide a heated hydrocarbon feed 106. The hydrocarbon feed 104 is provided to the combined feed exchanger 102 at a temperature of from about 38° C. to about 177° C. In an exemplary embodiment, the hydrocarbon feed 104 includes hydrogen-rich gas. The hydrogen-rich gas contains primarily hydrogen and it also may include methane, ethane, propane, butane and trace components like NH3 and H2S. The hydrogen-rich gas may be provided to the hydrocarbon feed 104 as make-up hydrogen gas, once-through hydrogen-rich gas or as a hydrogen-rich recycle gas stream.

In one example, the heated hydrocarbon feed 106 is above the dew point of the hydrocarbon feed 104. The heated hydrocarbon feed 106 is passed through the hydrotreating heating zone 108 to provide a heated hydrotreating zone feed 118. In accordance with the instant embodiment as shown, the heated hydrocarbon feed 106 is passed through the radiant section 114 of the charge heater 110 to provide the heated hydrotreating zone feed 118. As illustrated, the heated hydrocarbon feed 106 bypasses the convection section 116 of the charge heater 110. The heated hydrotreating zone feed 118 is introduced to the hydrotreating zone 120.

The hydrotreating zone 120 may include one or more hydrotreating reactors for removing sulfur and nitrogen from the heated hydrotreating zone feed 118. A number of reactions take place in the hydrotreating zone 120 including hydrogenation of olefins and hydrodesulfurization of mercaptans and other organic sulfur compounds; both of which (olefins, and sulfur compounds) are present in the naphtha fractions. Examples of sulfur compounds that may be present include dimethyl sulfide, thiophenes, benzothiophenes, and the like. Further, reactions in the hydrotreating zone 120 include removal of heteroatoms, such as nitrogen and metals.

Preferred hydrotreating reaction conditions include a temperature from about 260° C. (500° F.) to about 455° C. (850° F.), suitably about 316° C. (600° F.) to about 427° C. (800° F.) and preferably about 300° C. (572° F.) to about 399° C. (750° F.), a pressure from about 0.68 MPa (100 psig), preferably about 1.34 MPa (200 psig), to about 6.2 MPa (900 psig), a liquid hourly space velocity of the fresh hydrocarbon feedstock from about 0.2 $hr^{-1}$ to about 16 $hr^{-1}$, preferably from about 1.5 to about 8 $hr^{-1}$, and a hydrogen rate of about 34 $Nm^3/m^3$ hydrocarbon (200 scf/bbl) to about 1,011 $Nm^3/m^3$ hydrocarbon (6,000 scf/bbl), preferably about 67 $Nm^3/m^3$ oil (400 scf/bbl) to about 674 $Nm^3/m^3$ oil (4,000 scf/bbl), with a hydrotreating catalyst or a combination of hydrotreating catalysts.

Suitable hydrotreating catalysts include those comprising of at least one Group VIII metal, such as iron, cobalt, and nickel (e.g., cobalt and/or nickel) and at least one Group VI metal, such as molybdenum and tungsten, on a high surface area support material such as a refractory inorganic oxide (e.g., silica or alumina). A representative hydrotreating catalyst therefore comprises a metal selected from the group consisting of nickel, cobalt, tungsten, molybdenum, and mixtures thereof (e.g., a mixture of cobalt and molybdenum), deposited on a refractory inorganic oxide support (e.g., alumina).

Other suitable hydrotreating catalysts include zeolitic catalysts, as well as noble metal catalysts where the noble metal is selected from palladium and platinum. It is within the scope of the subject matter that more than one type of hydrotreating catalyst may be used in the same or a different reaction vessel. Two or more hydrotreating catalyst beds of the same or different catalyst and one or more quench points may be utilized in a reaction vessel or vessels to provide the hydrotreated product. At the quench points a cooling stream such as hydrogen or a portion of the feed stream may be fed to the hydrotreating zone 120 between catalyst beds to cool hydrotreated effluent from an upstream catalyst bed.

A hydrotreating zone effluent 122 is withdrawn from the hydrotreating zone 120. As illustrated, the hydrotreating heating zone 108 is in downstream communication with the hydrotreating zone 120 and the hydrotreating zone effluent 122 is passed through the hydrotreating heating zone 108 to provide a heated hydrotreating zone effluent 124. In accordance with the instant embodiment as shown, the hydrotreating zone effluent 122 is passed through the convection section 116 of the charge heater 110. The hydrotreating zone effluent 122 is heated with the flue gas from the radiant section 114 to provide the heated hydrotreating zone effluent 124. The hydrotreating zone effluent 122 exits the hydrotreating heating zone 108 at a higher temperature before entering the combined feed exchanger 102. In an exemplary embodiment, the hydrotreating zone effluent 122 has a temperature of from about 288° C. (550° F.)-about 315° C. (600° F.) to about 343° C. (650° F.)-about 371° C. (700° F.), and the heated hydrotreating zone effluent 124 has a temperature of from about 315° C. (600° F.)-about 343° C. (650° F.) to about 363° C. (685° F.)-about 385° C. (725° F.). Therefore, as per the exemplary embodiment, an existing high temperature stream; i.e., the hydrotreating zone effluent 122 is further heated, in contrast to conventional teachings, wherein a high temperature stream is cooled via indirect heat exchange with the hydrocarbon feed.

As illustrated, the combined feed exchanger 102 is in downstream communication with the hydrotreating heating zone 108, and the heated hydrotreating zone effluent 124 is sent to the combined feed exchanger 102. Preferably, the heated hydrotreating zone effluent 124 enters the combined feed exchanger tube side and heats the hydrocarbon feed 104 on the shell side. An indirect heat exchange takes place between the heated hydrotreating zone effluent 124 and the hydrocarbon feed 104 to provide the heated hydrocarbon feed 106. Also, a partially condensed product stream 126 is obtained from the combined feed exchanger 102 by cooling of the heated hydrotreating zone effluent 124.

It is an advantage over the conventional process to re-route the hydrotreating zone effluent 122 through the charge heater 110 prior to indirect heat exchange with the hydrocarbon feed 104. The instant flow-scheme would economically provide the additional preheat required to ensure the existing combined feed exchanger 102 provide a fully vaporized hydrocarbon feed to the charge heater 110. This novel flow scheme change provides a higher inlet temperature and an improved log mean temperature difference (LMTD) for the combined feed exchanger 102. With this higher hot inlet temperature and higher LMTD, the hydrocarbon feed 104 enters the charge heater 110 fully vaporized. Due to the increased hot inlet temperature and associated LMTD of the combined feed exchanger train, the heat pickup by the hydrocarbon feed 104 increases for the same surface area, therefore allowing complete vaporization of the hydrocarbon feed 104 prior to introduction to the charge heater 110. Since the hydrocarbon feed from the combined feed exchanger 102 enters the charge heater 110 at a higher temperature, the heat duty of the radiant section 116 of the charge heater 110 does not go up as this radiant duty is compensated by the increased heat pick up by the hydrocarbon feed 104 inside the combined feed exchanger 102. The pressure drop in the reactor loop increases only slightly since the feed and effluent are switched inside the convection section 116. The pressure drop inside the convection section 116 in the conventional flow scheme would have conventionally been on the combined feed side, and with the instant described subject matter the pressure drop would shift to the effluent side, rendering only slight increase in the total pressure drop in the reactor loop due to a lower density of the reactor effluent than the hydrocarbon feed flowing through the convection section.

EXAMPLE

The following is an example of the naphtha hydrotreating process, in accordance with an exemplary embodiment, that is similarly configured to the apparatus and method 100 illustrated in the FIGURE. The example is provided for illustration purposes only and is not meant to limit the various embodiments of apparatuses and methods for naphtha hydrotreating in any way.

In an exemplary case study, an NHT unit was revamped for a higher throughput. It was found that at a reactor effluent temperature of 600° F., the combined feed exchanger train was short by 57% with respect to the total effective heat exchange surface area available. With the existing shells the feed to the charge heater would only be 80% vaporized. The existing NHT unit had six CFE shells. To revamp the unit, six more shells in series or in parallel, were required to ensure that the combined feed to the charge heater is completely vaporized. Instead with the modified flow scheme as illustrated herein, it was found that only one shell in series is required to be added to the existing six series shells, and the combined feed to the charge heater can be vaporized completely, with a combined feed temperature about 15° F. above the combined feed dew point.

The cost of the revamp for two cases was as follows: The capital expense ("CAPEX") with the conventional flow scheme with 6 new shells equals US$1,570,000. In contrast, CAPEX with the instant subject matter flow scheme with 1 new shell equals US$260,000, hence resulting in significant savings using the instant flow scheme. Further, the pressure drop in the reactor loop using the instant subject matter flow scheme is 58% lower as compared to the conventional flow scheme, resulting in reduction of electric power requirement by at least 24%.

Specific Embodiments

While the following is described in conjunction with specific embodiments, it will be understood that this description is intended to illustrate and not limit the scope of the preceding description and the appended claims.

A first embodiment of the invention is a method for hydrotreating a hydrocarbon feed comprising heating a hydrotreating zone effluent to produce a heated hydrotreating zone effluent; and indirect heat exchanging the heated hydrotreating zone effluent with the hydrocarbon feed to provide a heated hydrocarbon feed. An embodiment of the invention is one, any or all of prior embodiments in this paragraph up through the first embodiment in this paragraph further comprising heating the heated hydrocarbon feed to produce a heated hydrotreating zone feed. An embodiment of the invention is one, any or all of prior embodiments in this paragraph up through the first embodiment in this paragraph, wherein heating the heated hydrocarbon feed comprises passing the heated hydrocarbon through at least one heater. An embodiment of the invention is one, any or all of prior embodiments in this paragraph up through the first embodiment in this paragraph, wherein heating the hydrotreating zone effluent comprises passing the hydrotreating zone effluent through at least one heater. An embodiment of the invention is one, any or all of prior embodiments in this paragraph up through the first embodiment in this paragraph, wherein the at least one heater is a charge heater comprising a plurality of burners, a radiant section, and a convection section wherein the heated hydrocarbon feed passes through the radiant section of the charge heater. An embodiment of the invention is one, any or all of prior embodiments in this paragraph up through the first embodiment in this paragraph, wherein the at least one heater is a charge heater comprising a plurality of burners, a radiant section, and a convection section wherein the hydrotreating zone effluent passes through the convection section of the charge heater. An embodiment of the invention is one, any or all of prior embodiments in this paragraph up through the first embodiment in this paragraph further comprising providing the heated hydrotreating zone feed to a hydrotreating zone and hydrotreating the heated hydrotreating zone feed to produce the hydrotreating zone effluent. An embodiment of the invention is one, any or all of prior embodiments in this paragraph up through the first embodiment in this paragraph, wherein the hydrocarbon feed comprises a naphtha fraction and a hydrogen-rich gas, the hydrogen-rich gas is provided as once-through hydrogen-rich gas, make-up gas or hydrogen-rich recycle gas stream. An embodiment of the invention is one, any or all of prior embodiments in this paragraph up through the first embodiment in this paragraph, wherein the naphtha fraction has a T5 boiling point of about 15-50° C. to and T90 boiling point of about 200-225° C. An embodiment of the invention is one, any or all of prior embodiments in this paragraph up through the first embodiment in this paragraph, wherein the hydrocarbon feed has a temperature of from about 38° C. (100° F.)-177° C. (350° F.). An embodiment of the invention is one, any or all of prior embodiments in this paragraph up through the first embodiment in this paragraph, wherein the heated hydrocarbon feed is above the dew point of the hydrocarbon feed. An embodiment of the invention is one, any or all of prior embodiments in this paragraph up through the first embodiment in this paragraph, wherein hydrotreating zone effluent has a temperature of from about 288° C. (550° F.)-315° C. (600° F.) to about 343° C. (650° F.)-371° C. (700° F.). An embodiment of the invention is one, any or all of prior embodiments in this paragraph up through the first embodiment in this paragraph, wherein the heated hydrotreating zone effluent has a temperature of from about 315° C. (600° F.)-343° C. (650° F.) to about 363° C. (685° F.)-385° C. (725° F.).

A second embodiment of the invention is a method for hydrotreating a hydrocarbon feed comprising a) heating the hydrocarbon feed to provide a heated hydrocarbon feed; b) heating the heated hydrocarbon feed to produce a heated hydrotreating zone feed; c) providing the heated hydrotreating zone feed to a hydrotreating zone to produce a hydrotreating zone effluent; d) heating the hydrotreating zone effluent to produce a heated hydrotreating zone effluent; and e) indirectly heat exchanging the heated hydrotreating zone effluent with the hydrocarbon feed to provide the heated hydrocarbon feed. An embodiment of the invention is one, any or all of prior embodiments in this paragraph up through the second embodiment in this paragraph, wherein heating the heated hydrocarbon feed comprises passing the heated hydrocarbon through at least one heater. An embodiment of the invention is one, any or all of prior embodiments in this paragraph up through the second embodiment in this paragraph, wherein heating the hydrotreating zone effluent comprises passing the hydrotreating zone effluent through at least one heater. An embodiment of the invention is one, any or all of prior embodiments in this paragraph up through the second embodiment in this paragraph, wherein the at least one heater is a charge heater comprising a plurality of burners, a radiant section, and a convection section wherein the heated hydrocarbon feed passes through the radiant section of the charge heater. An embodiment of the invention is one, any or all of prior embodiments in this paragraph up through the second embodiment in this paragraph, wherein the at least one heater is a charge heater comprising a plurality of burners, a radiant section, and a convection section wherein the hydrotreating zone effluent passes through the convection section of the charge heater. An embodiment of the invention is one, any or all of prior embodiments in this paragraph up through the second embodiment in this paragraph, wherein the hydrocarbon feed comprises a naphtha fraction and a hydrogen-rich gas, the hydrogen-rich is provided as once-through hydrogen-rich gas, make-up hydrogen gas or hydrogen-rich recycle gas stream.

A third embodiment of the invention is an apparatus for hydrotreating a hydrocarbon feed comprising a) a combined feed exchanger; b) a hydrotreating heating zone in fluid communication with the combined feed exchanger comprising a charge heater; and c) a hydrotreating zone that is in fluid communication with the hydrotreating heating zone; wherein the hydrotreating heating zone is in downstream communication with the hydrotreating zone and the combined feed exchanger is in downstream communication with the hydrotreating heating zone.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

What is claimed is:

1. A method for hydrotreating a hydrocarbon feed comprising:

heating a hydrotreating zone effluent by passing the hydrotreating zone effluent through a convection section of a charge heater to produce a heated hydrotreating zone effluent;

indirect heat exchanging the heated hydrotreating zone effluent with the hydrocarbon feed to provide a heated hydrocarbon feed;

heating the heated hydrocarbon feed by passing the heated hydrocarbon through the radiant section of the charge heater produce a heated hydrotreating zone feed; and hydrotreating the heated hydrotreating zone feed to produce the hydrotreating zone effluent.

2. The method of claim 1, wherein the charge heater further comprises a plurality of burners.

3. The method of claim 1, wherein the step of hydrotreating occurs in a hydrotreating zone.

4. The method of claim 1, wherein the hydrocarbon feed comprises a naphtha fraction and a hydrogen-rich gas, the hydrogen-rich gas is provided as once-through hydrogen-rich gas, make-up gas or hydrogen-rich recycle gas stream.

5. The method of claim 4, wherein the naphtha fraction has a T5 boiling point of about 15-50° C. to and T90 boiling point of about 200-225° C.

6. The method of claim 1, wherein the hydrocarbon feed has a temperature of from about 38° C. (100° F.)-177° C. (350° F.).

7. The method of claim 1, wherein the heated hydrocarbon feed is above the dew point of the hydrocarbon feed.

8. The method of claim 1, wherein hydrotreating zone effluent has a temperature of from about 288° C. (550° F.) to about −371° C. (700° F.).

9. The method of claim 1, wherein the heated hydrotreating zone effluent has a temperature of from about 315° C. (600° F.) to about 385° C. (725° F.).

10. A method for hydrotreating a hydrocarbon feed comprising:

a) heating the hydrocarbon feed to provide a heated hydrocarbon feed;

b) heating the heated hydrocarbon feed by passing the heated hydrocarbon feed through a radiant section of a charge heater to produce a heated hydrotreating zone feed;

c) providing the heated hydrotreating zone feed to a hydrotreating zone to produce a hydrotreating zone effluent;

d) heating the hydrotreating zone effluent by passing the hydrotreating zone effluent through a convection section of the charge heater to produce a heated hydrotreating zone effluent; and e) indirectly heat exchanging the heated hydrotreating zone effluent with the hydrocarbon feed to provide the heated hydrocarbon feed.

11. The method of claim 10, wherein the charge heater further comprises a plurality of burners.

12. The method of claim 10, wherein the hydrocarbon feed comprises a naphtha fraction and a hydrogen-rich gas, the hydrogen-rich is provided as once-through hydrogen-rich gas, make-up hydrogen gas or hydrogen-rich recycle gas stream.

* * * * *